United States Patent [19]

Andrieux

[11] Patent Number: 4,559,996

[45] Date of Patent: Dec. 24, 1985

[54] MODULAR BUNDLE OF TUBES FOR A STEAM CONDENSER, AND A STEAM CONDENSER USING SUCH MODULAR BUNDLES

[75] Inventor: Bernard Andrieux, Boulogne-Billancourt, France

[73] Assignee: Societe Anonyme Dite-Delas-Weir, Levallois-Perret, France

[21] Appl. No.: 615,188

[22] Filed: May 30, 1984

[30] Foreign Application Priority Data

Jun. 3, 1983 [FR] France ..... 83 09229

[51] Int. Cl.[4] ..... F28D 7/00; F28F 11/00; F28B 1/02

[52] U.S. Cl. ..... 165/76; 165/70; 165/111; 165/145; 165/162; 165/906

[58] Field of Search ..... 165/145, 158, 159, 76, 165/134 R, 162, 111, DIG. 9, 70

[56] References Cited

U.S. PATENT DOCUMENTS

| | | | |
|---|---|---|---|
| 704,454 | 7/1902 | Fergusson | 165/145 |
| 1,842,945 | 1/1932 | Price et al. | 165/162 |
| 1,918,608 | 7/1933 | Mahoney | 165/145 |
| 2,036,957 | 4/1936 | Price | 165/162 |
| 2,059,967 | 11/1936 | Leach | 165/67 |
| 2,181,486 | 11/1939 | Jenkins | 165/159 |
| 2,237,903 | 4/1941 | Drake | 165/82 |
| 2,552,416 | 5/1951 | Farkas | 165/111 |
| 2,595,822 | 5/1952 | Uggerby | 165/159 |
| 3,231,015 | 1/1966 | Koch | 165/145 |
| 3,332,477 | 7/1967 | Saunders | 165/76 |
| 3,861,460 | 1/1975 | Lenhardt | 165/111 |
| 3,986,549 | 10/1976 | Huggins et al. | 165/145 |
| 4,202,407 | 5/1980 | Woitowitz | 165/145 |
| 4,253,516 | 3/1981 | Giardina | 165/162 |

FOREIGN PATENT DOCUMENTS

| | | | |
|---|---|---|---|
| 420242 | 1/1911 | France . | |
| 1211918 | 3/1960 | France . | |
| 2126323 | 6/1972 | France . | |
| 674652 | 6/1952 | United Kingdom | 165/158 |

*Primary Examiner*—Albert W. Davis, Jr.
*Assistant Examiner*—John K. Ford
*Attorney, Agent, or Firm*—Sughrue, Mion, Zinn Macpeak & Seas

[57] ABSTRACT

A modular bundle of tubes for a steam condenser comprises two perforated plates (24, 25), a series of tubes (22) interconnecting the perforated plates, and a set of intermediate supporting plates (23) distributed between the two perforated plates. The improvement wherein both perforated plates are the same size, each being surrounded by a reinforcing frame (24, 25) which is thicker than the perforated plate, and wherein drawbars (26) fitted with length-adjusting means (27) interconnect the perforated plates, said drawbars being fixed to said frames and being distributed along the said frames.

3 Claims, 9 Drawing Figures

MODULAR BUNDLE OF TUBES FOR A STEAM CONDENSER, AND A STEAM CONDENSER USING SUCH MODULAR BUNDLES

The present invention relates to steam condensers. A steam condenser for an electricity power station is constituted by an assembly of tubes having each of their ends connected to a perforated plate, the assembly being placed inside a condenser body which is connected to the exhaust from the turbines, and a water tank is connected to each perforated plate.

BACKGROUND OF THE INVENTION

Generally speaking, the tubes are mounted in the perforated plates and are then fixed thereto by expanding or by welding at the power station size. This operation takes a long time since there are many tubes to be put into place.

Work has thus been done to provide modular bundles of tubes which are factory-built so as to minimize the number of operations that need to be performed on site, and hence to reduce the time spent on site.

FIGS. 1 and 2 thus show an example of a known arrangement used at the San Onofré power station in California, USA. The steam condenser comprises a bundle of tubes 1 between perforated plates 2 and 3 which is constructed in a factory and then assembled, on site, with the body of the condenser 4.

The bundle of tubes comprises four modules which are assembled together on site. Before the modules arrive, the condenser body is terminated by two right-angled portions 5 and 6. In known manner the portion 6 has four windows as shown in FIG. 2. The left hand side of the body 4 as seen in FIG. 1 terminates with a portion 7. The perforated plate 3 of each module is connected to a frame 8 by means of screws 9. Portions 10 and 11 are welded to appropriate faces of the frame to close the condenser body. The left hand water tank 12 on site is terminated by a plate 13 which is of the same shape as the part 6 shown in FIG. 2, which is why the part shown in FIG. 2 is referenced 13-6. The plate 13 is fixed to the four perforated plates 3 to hold them together.

Assembly thus takes place as follows: each module comprises a simple perforated plate 2 at its right hand end (as seen in FIG. 1) while at its left hand end it comprises the perforated plate 3 together with the parts 8, 10 and 11. The module made in this way is inserted from right to left through one of the four windows in the portion 6 until the perforated plate 2 abuts against the portion 6 via a gasket 18. The assembly is then fixed by means of screws 15 and the plates 11 are welded to the body 4. The water tank 12, 13 is then fixed on by means of screws 16.

Gaskets 14 and 19 are disposed on either side of the perforated plate 3, between the perforated plate and the frame 8 and between the perforated plate and the frame 13.

This structure has several drawbacks. In particular, it is impossible to verify the gaskets 18 and 19 once the parts are assembled and the weld 17 has been made; the welding 17 is done on site; the assembly is asymmetrical; and prior to assembly the modules are insufficiently rigid.

Preferred embodiments of the present invention mitigate these drawbacks and provide a solution which is more satisfactory, more practical, and more reliable.

SUMMARY OF THE INVENTION

The present invention provides a modular bundle of tubes for a steam condenser comprising two perforated plates, a series of tubes interconnecting the perforated plates, and a set of intermediate supporting plates distributed between the two perforated plates, the improvement wherein both perforated plates are the same size, each being surrounded by a reinforcing frame which is thicker than the perforated plate, and wherein drawbars fitted with length-adjusting means interconnect the perforated plates, said drawbars being fixed to said frames and being distributed along the same frames.

The invention also provides a steam condenser comprising a skin containing a bundle of tubes which is associated at each end with a water tank, wherein the said bundle of tubes is made by assembling in parallel a plurality n of such modular bundles of tubes.

In a preferred embodiment of the invention, the n bundles of tubes are assembled at each end by means of an assembly frame having n windows and bearing against and fixed to the reinforcing frame of each modular bundle on the outside thereof relative to the tubes, the outer perimeter of the assembly frame having an external extension projecting beyond the outer perimeter of the assembled bundles of tubes, said assembly frame being fixed along said outer edge to a flange on the skin of the condenser, the size of the passage through the flange being the same at each end of the condenser.

BRIEF DESCRIPTION OF THE DRAWING

An embodiment of the invention is described by way of example with reference to the accompanying drawings, in which.

MORE DETAILED DESCRIPTION

Figure 1:
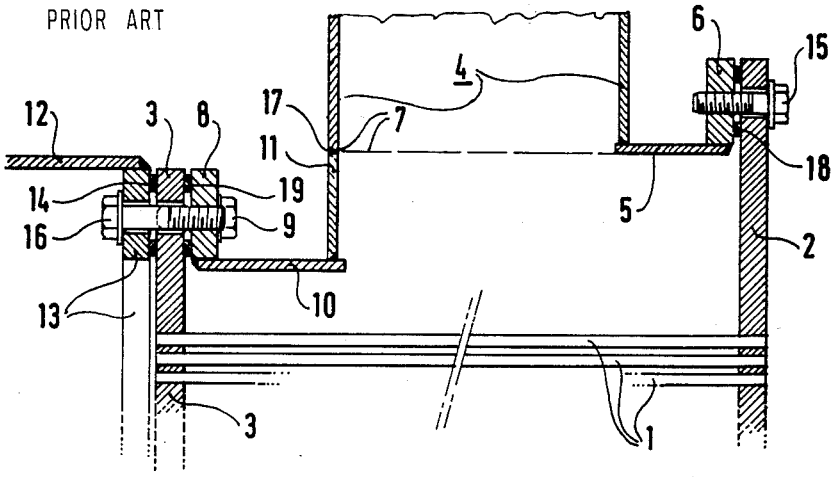
FIG. 1 PRIOR ART
FIGS. 1 and 2 are diagrams showing details of a prior art condenser constructed from factory-built modules which are assembled on site.
Figure 2:
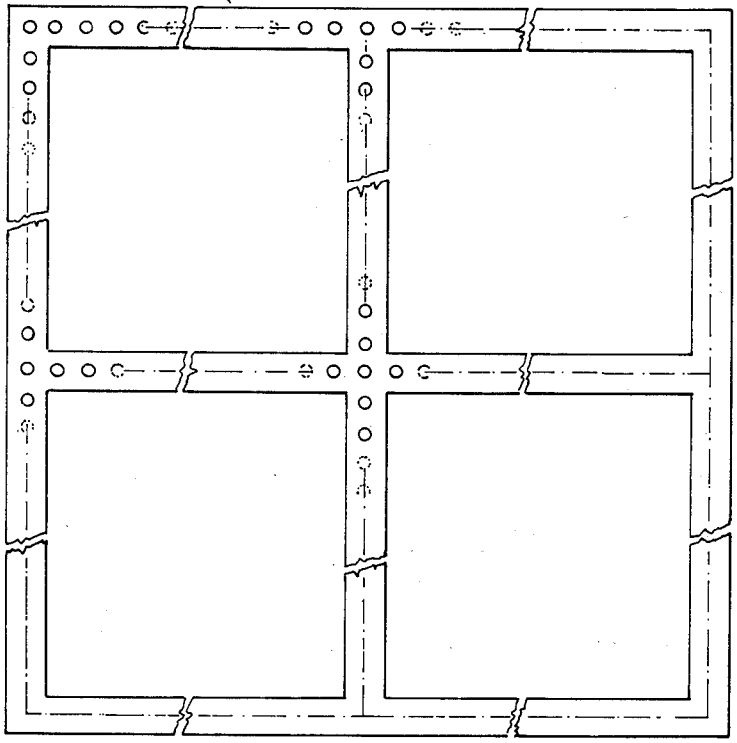
FIG. 2 PRIOR ART
Figure 3:
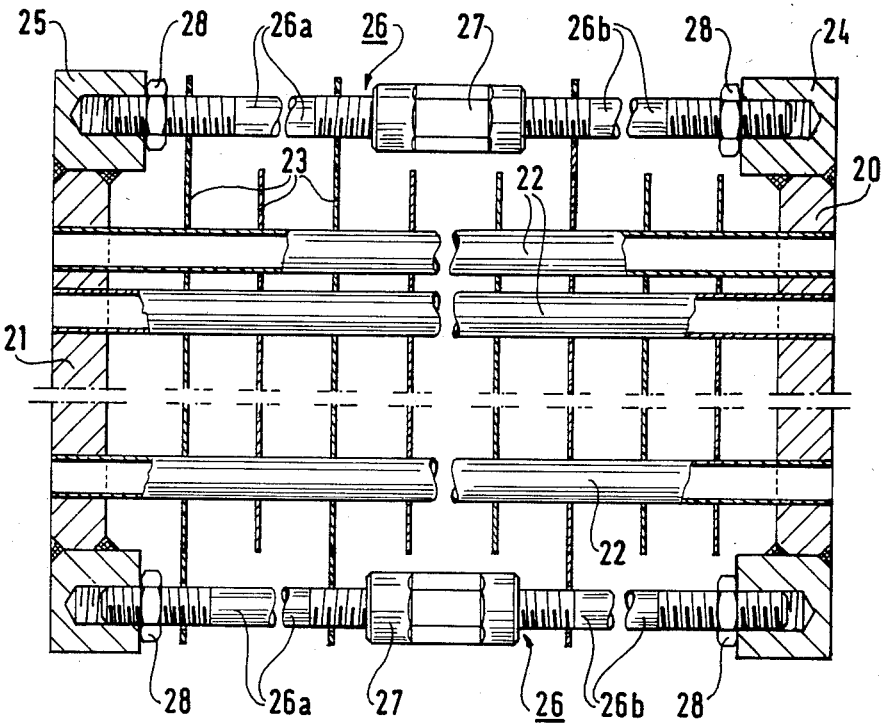
FIG. 3 shows a modular bundle of tubes in accordance with the invention.
Figure 4:
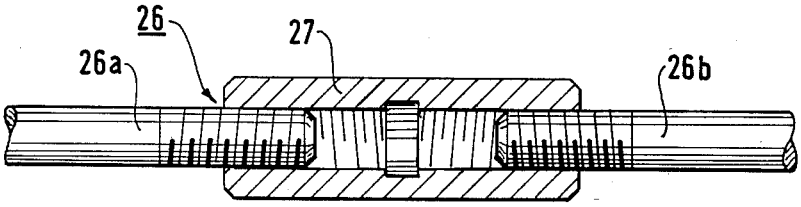
FIG. 4 is a view in partial section and to a larger scale of turnbuckle length-adjusting means used in the FIG. 3 bundle.

FIG. 3 shows a modular bundle of tubes in accordance with the invention. It comprises two perforated end plates 20 and 21, and a plurality of intermediate supporting plates 23. Each perforated plate is surrounded by a reinforcing frame: 24 for the plate 20; and 25 for the plate 21. The reinforcing frames are welded to their respective plates. Finally, a series of drawbars 26 interconnect the two plates and include length-adjusting means that enable them to set the distance between the plates with accuracy. These means are shown in greater detail in FIG. 4. The drawbars are at a spacing of about 500 mm. At least some of the intermediate supporting plates 23 are connected to the drawbars to increase the rigidity of the assembly. The length-adjusting means comprise a turnbuckle 27 having a bore which is tapped from each end with opposite handed threads. The drawbars are made in two parts 26*a* and 26*b*, and their respective ends have opposite handed external threads which are screwed into the turnbuckle. Lock nuts 28 at the other ends of the draw rod parts lock them in position in the end frames.

The frames 24 and 25 and the drawbars 26 together with the intermediate supporting plates 23 give the assembly excellent rigidity. The module is symmetrical and the perforated plates at both ends of the tubes in the bundle are of the same size.

Figure 5:
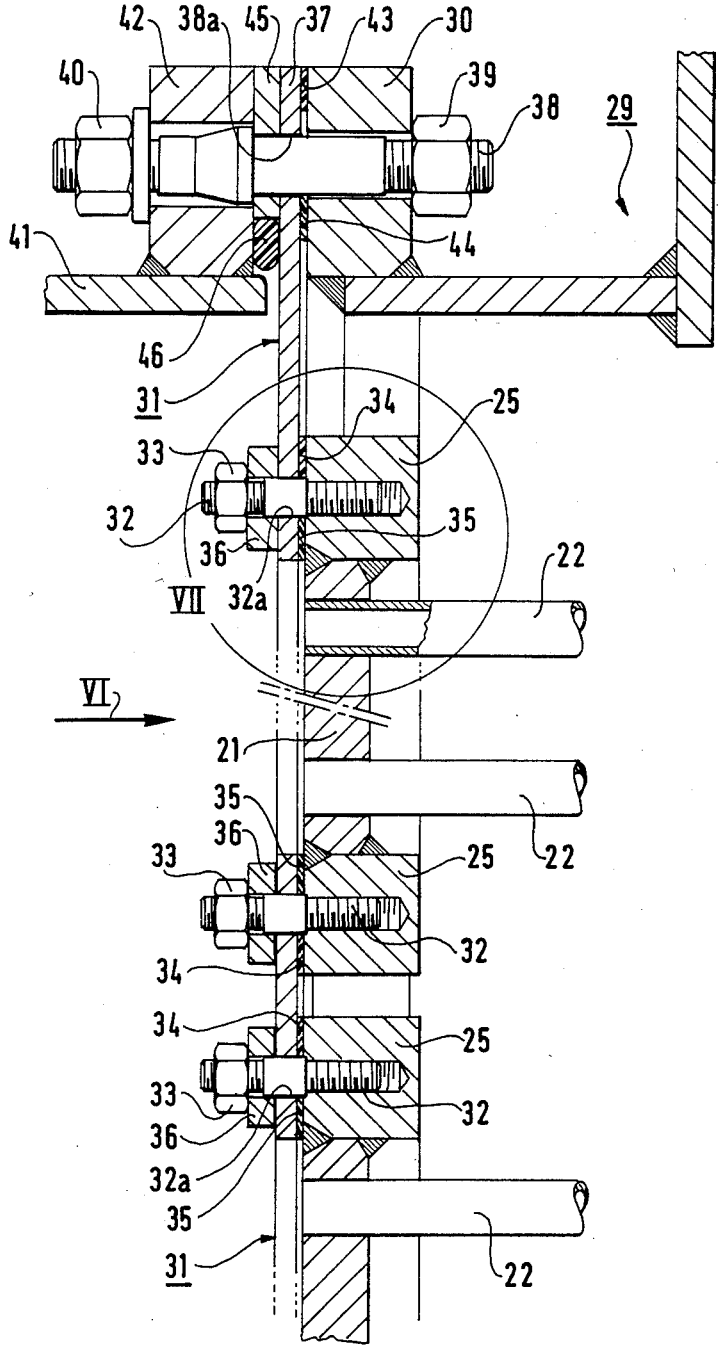
FIG. 5 is a view of a portion of the assembly of modular bundles of tubes mounted in a condenser enclosure.
Figure 6:
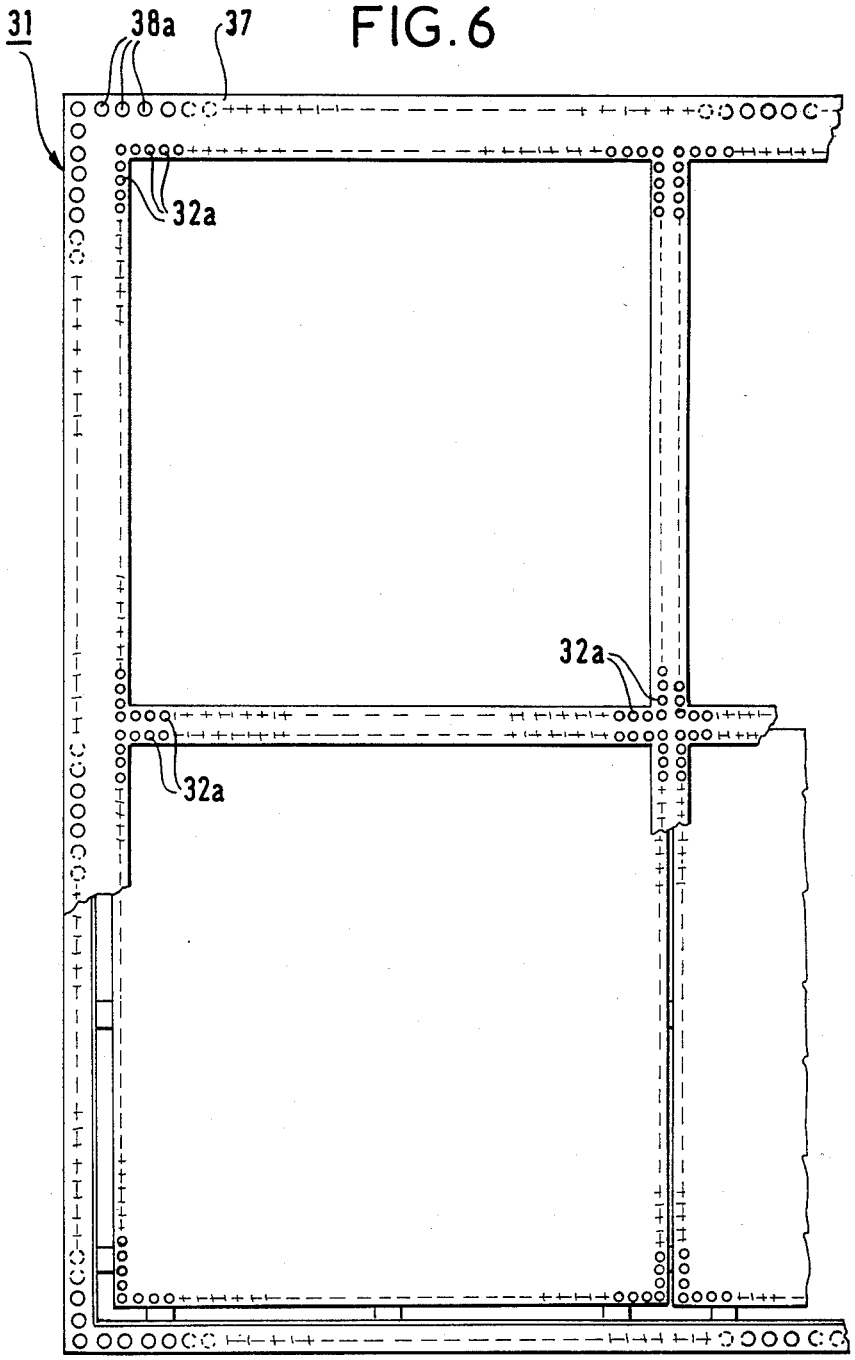
FIG. 6 is a view in the direction of arrow VI in FIG. 5 showing the geometry of a frame for assembling various modules.

FIG. 5 shows the manner in which a module, such as the module shown in FIG. 3, is assembled together with three other identical modules and then inside a condenser enclosure.

The condenser has an outer skin 29 which is shown in part.

At each end of the condenser skin there is a flange 30 which is welded to the skin and serves to fix the set of four assembled modules inside the skin.

FIG. 5 shows only a small portion, but the overall assembly is symmetrical, left to right and top to bottom.

The modules are assembled to one another by means of an assembly frame 31 which bears against the four end frames 25 of the modules to be assembled together. The parts are fixed to one another by stud bolts 32 passing through holes 32*a* in the frame 31, with nuts 33. Gaskets 34 and 35 are interposed around each of the frames 25 on each module between the frame 31 and the respective frames 25.

Likewise, bearing strips 36 are interposed all along the frame in 500 mm lengths between the nuts 33 and the frame 31.

Finally, the outer perimeter of the frame 31 has an outward extension 37 which projects beyond the outside perimeter of the complete assembled bundle of tubes for fixing to the flanges 30 by means of threaded rods 38 passing through holes 38*a* in the assembly frame, together with nuts 39 and 40. Gaskets 43 and 44 are interposed between the outer edge 37 of the frame 31 and the flange 30.

Likewise, a bearing frame 45 and a gasket 46 are interposed between the flange 42 and the frame 31.

Figure 7:
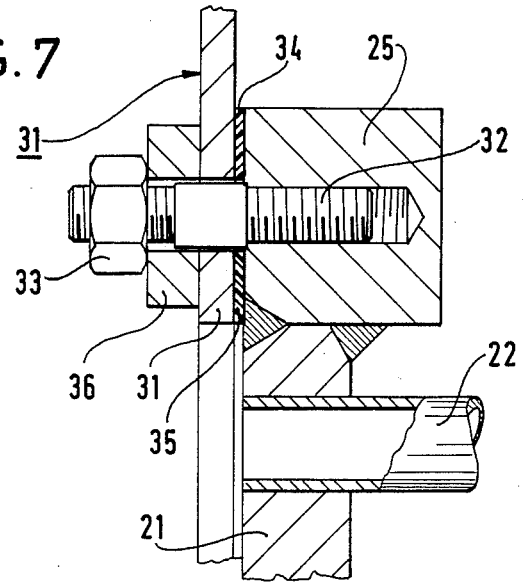
FIG. 7 is a view on an enlarged scale of a detail marked VII in FIG. 5.

FIG. 7 is a view on an enlarged scale of the part marked VII in FIG. 5.

Figure 8:
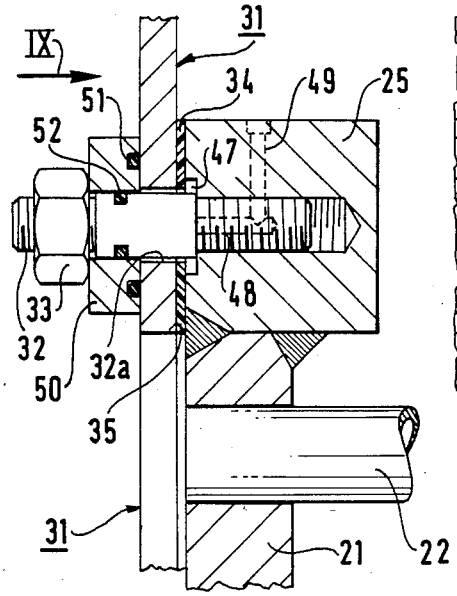
FIG. 8 shows a variant of the FIG. 7 detail.
Figure 9:
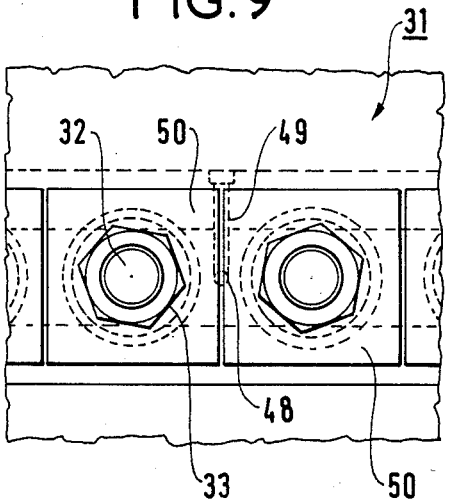
FIG. 9 is a view along arrow IX in FIG. 8.

FIG. 8 shows a variant of FIG. 7 in which the gaskets 34 and 35 are protected by a hydraulic barrier. Each reinforcing frame 25 is thus provided with facing 47 all around its periphery, the facing is connected by channels 48 and 49 to a water supply, not shown, at a higher pressure than the cooling water arriving in the water tank 41 (FIG. 5). The bearing plates 36 are then replaced by individual thick washers 50. The gaskets 51 and 52 are interposed between the frame 31 and the washers 50 and between the washers 50 and the rods 32.

In the example described, the assembly frame 31 is fixed to the frames 25 of the modules by screws, which is the preferred reinforcing method. However, other fixing means could be used, and the assembly frame 31 could be welded to the reinforcing frames 25, for example.

What is claimed is:

1. A steam condenser comprising a condenser skin containing a bundle of tubes and being operatively coupled at each end with a water tank, the improvement wherein said bundle of tubes comprises an assembly in parallel of a plurality n of modular bundles of tubes, each of said modular bundle of tubes comprising two perforated end plates, a series of said tubes being fitted into the perforations of said end plates and interconnecting the perforated end plates, a set of intermediate supporting plates distributed between the two perforated end plates, both perforated end plates being of the same size, a reinforcing frame surrounding each perforated end plate which is thicker than the perforated end plate and being fixed along the periphery of the end plate to said end plate, draw bars fitted with length adjusting means interconnecting said perforated end plates, said draw bars being fixed to the reinforcing frames and being distributed along said reinforcing frames, an assembly frame having n windows bearing against and being fixed to the reinforcing frame of each modular bundles of tubes on the outside thereof relative to said tubes to effect assembly of the bundle of tubes at each end by means of said assembly frame, the outer perimeter of the assembly frame having an external extension projecting beyond the reinforcing frame forming the outer perimeter of the assembled bundles of tubes, said condenser skin including a flange, and said assembly frame being fixed to said flange, and the condenser skin comprising a passage through the flange which is the same size at each end of the condenser.

2. A condenser according to claim 1, wherein the means for fixing the assembly frame to the reinforcing frames on the n modules comprise screw means.

3. A condenser according to claim 2, wherein the said screw means for fixing is sealed by means of gaskets and a hydraulic barrier.

* * * * *